United States Patent [19]

Lotspeich

[11] 4,094,440

[45] June 13, 1978

[54] SAFETY DOOR MECHANISM

[75] Inventor: Joseph A. Lotspeich, Eagan, Minn.

[73] Assignee: Gross-Given Manufacturing Company, St. Paul, Minn.

[21] Appl. No.: 725,881

[22] Filed: Sep. 23, 1976

[51] Int. Cl.[2] ..... G07F 11/00

[52] U.S. Cl. ..... 221/12; 221/129

[58] Field of Search ..... 221/125, 126, 127, 129, 221/149, 12; 194/10; 49/101, 114; 312/291

[56] References Cited

U.S. PATENT DOCUMENTS

| | | | |
|---|---|---|---|
| 3,174,646 | 3/1965 | Johnson | 221/129 |
| 3,344,953 | 10/1967 | Krakauer et al. | 221/129 X |
| 3,901,366 | 8/1975 | Schuller et al. | 221/12 X |
| 3,940,016 | 2/1976 | Krakauer | 221/129 |

*Primary Examiner*—Stanley H. Tollberg
*Assistant Examiner*—Fred A. Silverberg
*Attorney, Agent, or Firm*—Merchant, Gould, Smith, Edell, Welter & Schmidt

[57] ABSTRACT

A safety door mechanism for use in combination with delivery bins of dispensing machines. A dispensing chamber having a top supply opening and a front delivery opening is provided with a delivery door pivoted about a horizontal axis near the top of the delivery opening and with a supply door pivoted about a horizontal axis near the front of the supply opening. The delivery door is normally positioned by gravity to close the delivery opening, while the supply door is positioned by gravity to normally clear the supply opening. A mechanical linkage cooperatively interconnects the doors so that when the delivery door is manually opened the linkage closes the supply door at a closing rate which initially exceeds the opening rate of the delivery door, and in a manner such that the supply opening is substantially closed before the delivery opening is accessible.

9 Claims, 7 Drawing Figures

SAFETY DOOR MECHANISM

BACKGROUND OF THE INVENTION

1. Field of the Invention

The present invention generally relates to safety door mechanisms and more particularly to such safety door mechanisms for use in combination with dispensing machines. Through the use of a unique linkage mechanism, access to the interior of a dispensing machine and the products therein contained is prevented upon the opening of access to the dispensing chamber of the machine.

2. Description of the Prior Art

Dispensing machines have typically utilized a dispensing chamber into which the product to be vended is delivered. The product is retrieved from the dispensing chamber by the purchaser, usually through a delivery door. Devices utilizing such an arrangment require that the dispensing chamber be in communication with the product storage area located within the machine through a product supply chute so that the item to be vended can be delivered to the dispensing chamber. Obtaining access to the dispensing chamber has also resulted in obtaining access to the product storage area. Upon obtaining access to the dispensing chamber, the product storage area can be reached through the product supply chute. This structure has created the possibility of a person obtaining items from the product storage area for which he has not yet paid.

Dispensing machines of the prior art utilize various devices to solve this problem. Typically, such devices have employed a supply door to close-off the product supply chute upon opening of the delivery door. In one such device, the supply doors are normally open to permit passage of an item from the product storage area into the dispensing chamber and are operatively connected to the delivery door in a manner such that movement of the delivery door in an opening direction closes the supply door. Another such device utilizes a supply door which is normally maintained in a closed position. A sensing device within the product supply chute opens the normally closed supply door upon passage of an item from the product storage area. Such devices usually are quite complex, and are susceptible to low realiability.

The prior art devices, however, have all proven to be unsatisfactory for one reason or another. Those devices utilizing a normally open supply door are operatively connected to the delivery door in such a manner that when the delivery door is partially opened, the supply door is only partially closed. While such devices may have proved satisfactory to prevent the passage of a human hand from the dispensing chamber into the product supply chute, they do not completely eliminate access to the product storage area. Various tools can be utilized by vandals to obtain access to product storage area through such partially closed supply doors. With such devices, problems have also been encountered by animals such as rodents and the like which can obtain access to the product storage area through a partially open delivery door and a partially closed supply door, which combination may otherwise be a sufficient guard against access by human hands. Those devices utilizing the normally closed supply door have generally proven to be unsatisfactory due to the complicated machinery required for their implementation.

SUMMARY OF THE INVENTION

The present invention solves the problems associated with the prior art safety door devices. The present invention utilizes a unique linkage mechanism in combination with a normally open supply door to assure that the supply door is completely closed by the time the delivery door is even partially opened.

The present invention includes a dispensing chamber having an upper supply opening and a delivery opening located at its front. A delivery door and a supply door, both pivotal about generally horizontal axes located near the top of the delivery opening, are utilized in combination with the delivery opening and supply opening, respectively. The delivery door is maintained by gravity in a generally closed position, while the supply door is maintained by gravity in a generally open position. Unique mechanical linkage means operatively connects the delivery and supply doors in a manner such that manual opening of the delivery door cooperatively causes closing of the supply door at a rate which is initially greater than the opening rate of the delivery door, causing the supply opening to be closed before opening of the delivery opening.

A delivery door lever arm pivots with the delivery door and has a first drive pin at one end. The first drive pin is operatively received by a arcuate slit contained in one arm of the bell crank having a fixed center pivot. A second, shorter arm of the bell crank contains a first pivot pin. A supply door lever arm pivots with the supply door and has a second drive pin at one end. The second drive pin is operatively received by a arcuate slit contained in a first portion of a lever having a fixed pivot point. A second, shorter portion of the fixed pivot lever contains a second pivot pin which is operatively attached to the first pivot pin of the bell crank by means of a link member.

DESCRIPTION OF THE PREFERRED EMBODIMENT

Figure 1:
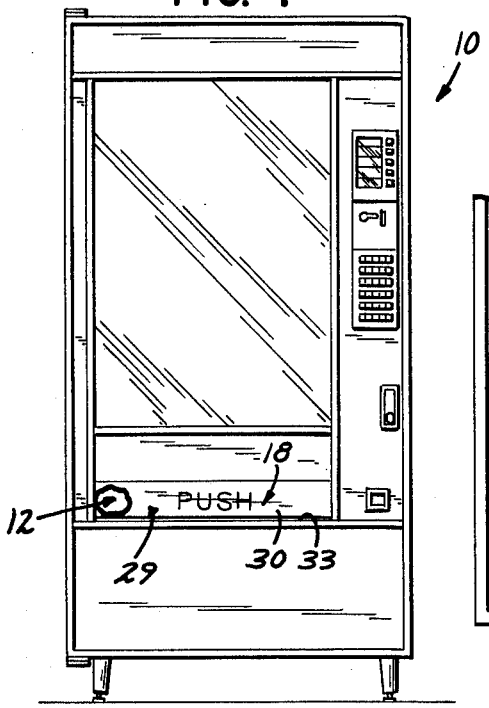
FIG. 1 is a view in front elevation of a front panel of a vending machine containing a safety dispensing apparatus constructed according to the principles of the present invention.
Figure 2:
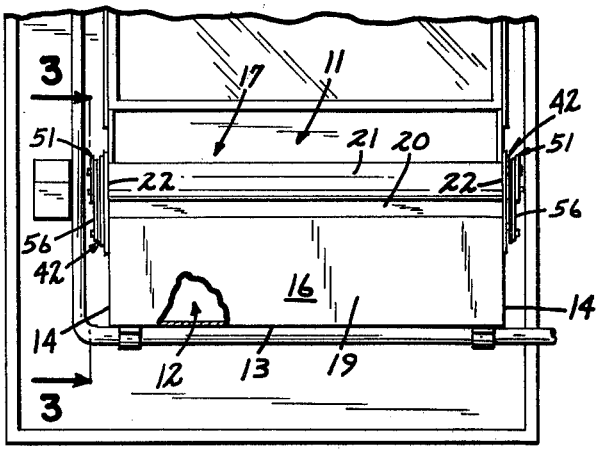
FIG. 2 is a view in rear elevation of the safety apparatus disclosed in FIG. 1 with portions thereof broken away.
Figure 6:
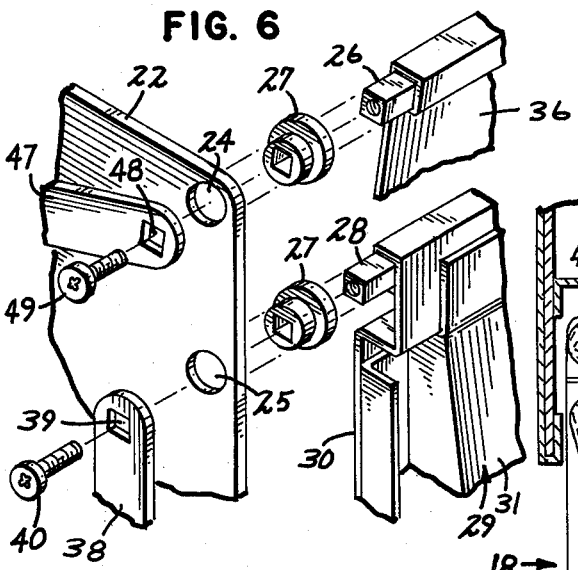
FIG. 6 is an exploded view in perspective disclosing a manner of attaching the delivery and supply doors to the mechanical linkage according to the principles of the present invention, with portions thereof broken away.

Referring to the Drawings, wherein like numbers represent like elements throughout the several views, there is provided in combination with a vending machine generally designated at 10, a safety door mechanism generally designated at 11. The safety door mechanism 11 includes a dispensing chamber 12 located adjacent the bottom portion of the front of the vending machine 10 and extending substantially across the width of the vending machine 10. The dispensing chamber 12 is defined by a bottom wall 13, side walls 14, a front wall 15 and a rear wall 16. The dispensing chamber 12 is open at its top end to define a supply opening 17. The front wall 15 of the dispensing chamber 12 extends only partially up the vertical height of the dispensing chamber 12 so as to define a delivery opening 18 in the top, front portion of the dispensing chamber 12.

The rear wall 16 of the dispensing chamber 12 includes a first portion 19 extending from the bottom wall 13 in an upwardly diverging manner, a second portion 20 extending from the first portion 19 in an upwardly converging manner and a third, curved portion 21 extending upwardly from the second portion 20 in an arcuate divergent manner. The significance of this shape will become more apparent upon a more complete description of the invention.

Mounting plates 22 are attached to each of the side walls 14 of the dispensing chamber 12 adjacent the delivery opening 18. The mounting plates 22 are attached to the side walls 14 by mounting screws 23 or by other appropriate securing means. The upper forward corner of each mounting plate 22 has two vertically spaced openings 24 and 25, respectively. Extending between the pair of openings 24 of each of the mounting plates 22 is a supply door hanger 26. The supply door hanger 26 has a generally rectangular cross section. Each of the ends of the supply door hanger 26 extends through a fitting 27 which matingly engages the respective opening 24 of each of the mounting plates 22. In this manner, the rectangular end of the supply door hanger 26 extends through the openings 24 of the mounting plates 22.

In similar manner, a delivery door hanger 28 extends between the pair of openings 25 of the mounting plates 22. The delivery door hanger 28 also has a generally rectangular cross section and extends through fittings 27 at each end. The fittings 27 matingly extend into the respective openings 25 of the mounting plates 22 in a manner such that the end of the delivery door hanger 28 extends through the holes 25 of the mounting plates 22.

A delivery door 29 is mounted to operatively hang from the delivery door hanger 28 and extends across the delivery opening 18. The top of the delivery door 29 is wrapped around or otherwise suitably attached to the delivery door hanger 28 in a manner such that the delivery door 29 pivots in response to an inwardly directed force applied thereto about a horizontal axis corresponding to the center line of the delivery door hanger 28. The delivery door 29 vertically extends from the delivery door hanger 28 to the top of the front wall 15 to cover the entire delivery opening 18.

The delivery door 29 comprises a front panel 30 and a rear panel 31 attached at their respective top ends adjacent the delivery door hanger 28, and are also connected by means of a bottom panel 32 adjacent the top of the front wall 15. The front wall 15 has an outwardly extending lip 33. When in its normally closed position, the delivery door 29 hangs from the delivery door hanger 28, by force of gravity, in such a manner that the bottom panel 32 is positioned adjacent the lip 33. The rear panel 31 of the delivery door 29 contains an inwardly extending flange 35 to which is attached a dispensing lip 34. In its normally closed position the dispensing lip 34 of the delivery door 29 abuts the top of the front wall 15, thus completely closing access to the dispensing chamber 12 and preventing the delivery door 29 from being opened outwardly of the dispensing chamber 12.

Similarily, a supply door 36 is hung from the supply door hanger 26. The supply door 36 is positioned interiorly of the delivery door 29 and extends vertically downward past the top of the front wall 15. In its normal position, the supply door 36 hangs under force of gravity, in a generally vertically downward position adjacent the delivery door 29. Thus, the supply opening 17 is normally open. The supply door 36 may contain creases which add reinforcing strength to the supply door, as is well known in the art.

Mechanical linkage means mounted to the respective outer sides of the mounting plates 22 operatively connect the supply door 36 to the delivery door 29. Each of the linkage means includes a delivery door lever arm 38 having a rectangular opening 39 in one of its ends matingly connected to the end of the delivery door hanger 28 extending through the respective mounting plate 22. The delivery door lever arm 38 is secured to the end of the delivery door hanger 28 by a threaded fastener 40 or by some other appropriate fastening means. The opposite end of the delivery door lever arm 38 contains a drive pin 41 extending outwardly from the mounting plate 22.

Each linkage means is provided with a bell crank 42 having a fixed center pivot. The bell crank 42 includes a first, lever arm 43 and a second, relatively shorter lever arm 44 disposed approximately perpendicularly to the first longer lever arm 43. The bell crank 42 is fixedly pivoted at the juncture of the lever arms 43 and 44. The first lever arm 43 contains an arcuate slit 45 extending generally radially outward from the pivot point of the bell crank 42. The drive pin 41 of the delivery door lever arm 38 is operatively received by the arcuate slits 45 of the bell crank 42 and maintained therein by retaining ring 46 in such a manner that the drive pin 41 is free to travel within the arcuate slit 45.

In similar manner, each of the linkages contains a supply door lever arm 47 having a rectangular opening 48 located at one of its ends. The supply door lever arm 47 is matingly connected to the end of the supply door hanger 26 and there held in position by means of a fastener 49. The opposite end of the supply door lever arm 47 contains a second drive pin 50. A fixed pivot lever 51 is mounted on the mounting plate 22. The fixed pivot lever 51 comprises a first lever arm 52 and a second, relatively shorter lever arm 53 extending oppositely of the first lever arm 52. The first lever arm 52 contains an arcuate slit 54 positioned radially of the pivot point of the lever 51 and having an increasing radius about that point. The second arcuate slit 54 receives the second drive pin 50 of the supply door lever arm 45, the second drive pin 50 being held in place by a retaining ring 55. The second drive pin 50 is free to travel along the length of the arcuate slit 54.

The second, shorter lever arm 44 of the bell crank 42 is connected to the second, shorter lever arm 53 of the fixed pivot lever 51 by means of a link 56. The link 56 is connected at its ends to the corresponding second, shorter lever arms by means of a pivot pin 57.

In operation, upon the application of an inward force imparted to the delivery door 29, opening movement of the delivery door 29 will cause cooperative closing movement of the supply door 36 at a rate which initially exceeds the opening rate of the delivery door 29. This is accomplished by means of the linkage above described. In this manner, the supply door 36 pivots about the supply door hanger 26 and closes the supply opening 17 before the front panel 30 of the delivery door 29 clears the top of the front wall 15. It is contemplated that the third, curved portion 21 of the rear wall 16 will generally conform to a portion of the arc swept by the bottom of the supply door 36. The third portion 21 of the rear wall 16 has located at its upper edge an inwardly downwardly reclined lip 58 which abuts the bottom of the supply door 36 upon complete opening of the delivery door 29.

Figure 5:
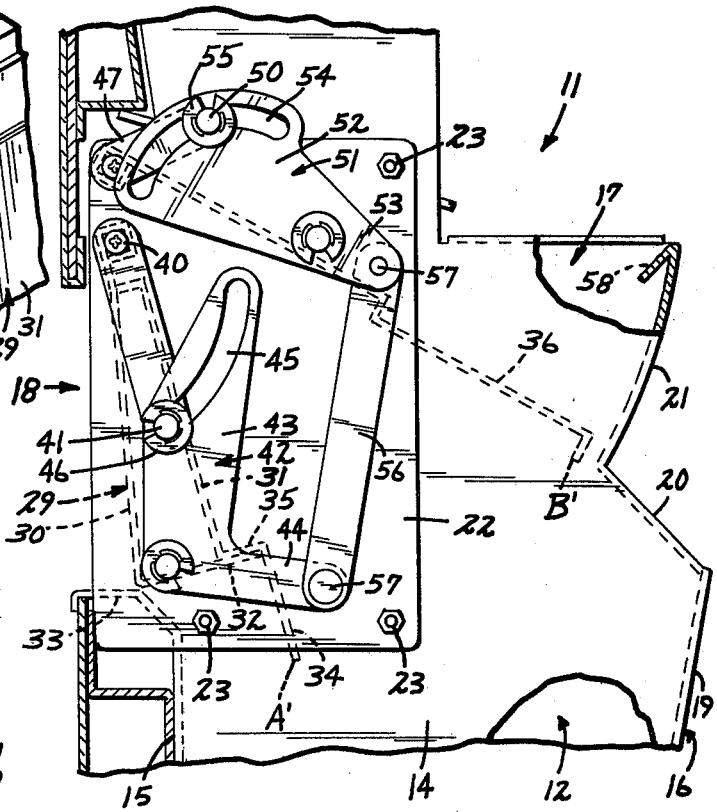
FIG. 5 is a view in side elevation taken generally along the line 3—3 in FIG. 2 illustrating the safety dispensing apparatus as operatively disposed in a partially open position.
Figure 7:
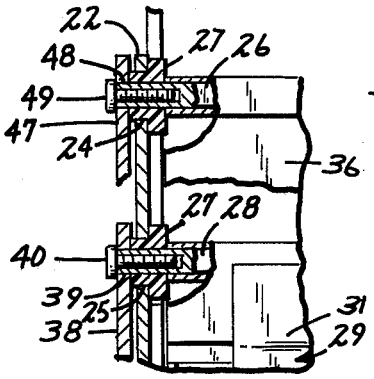
FIG. 7 is a sectional view in rear elevation disclosing a manner of attaching the delivery and supply doors to the mechanical linkage according to the principles of the present invention, with portions thereof broken away.
Figure 4:
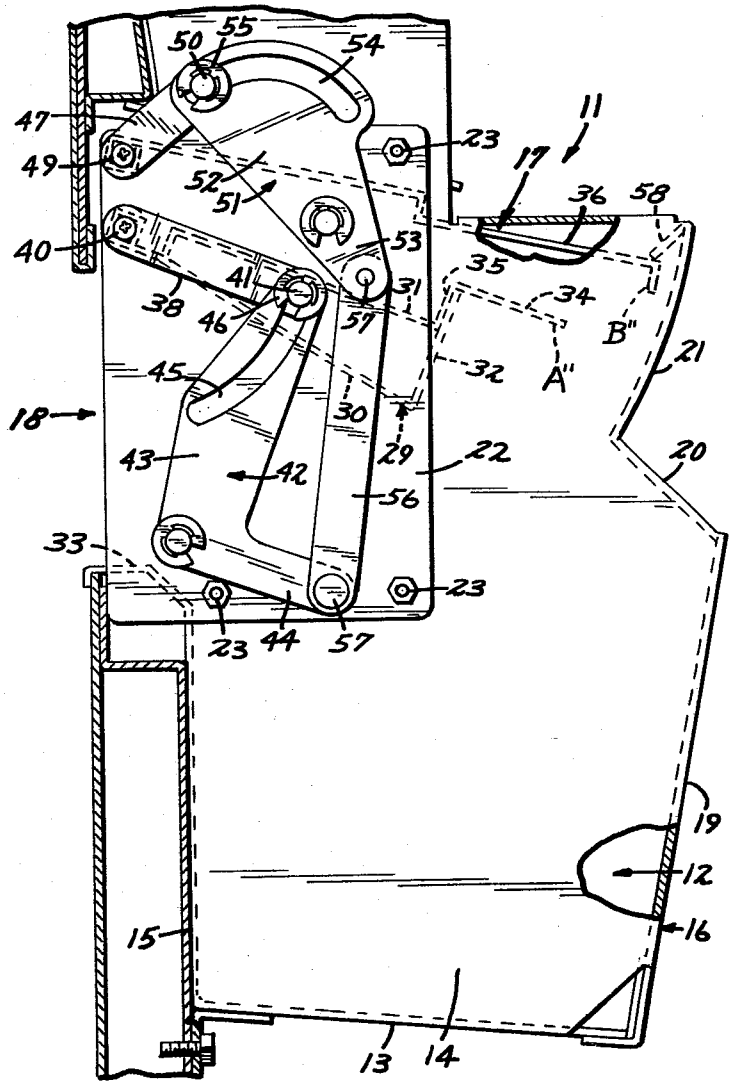
FIG. 4 is a view in side elevation taken generally along the line 3—3 in FIG. 2 illustrating the safety dispensing apparatus as disposed in its open position.
Figure 3:
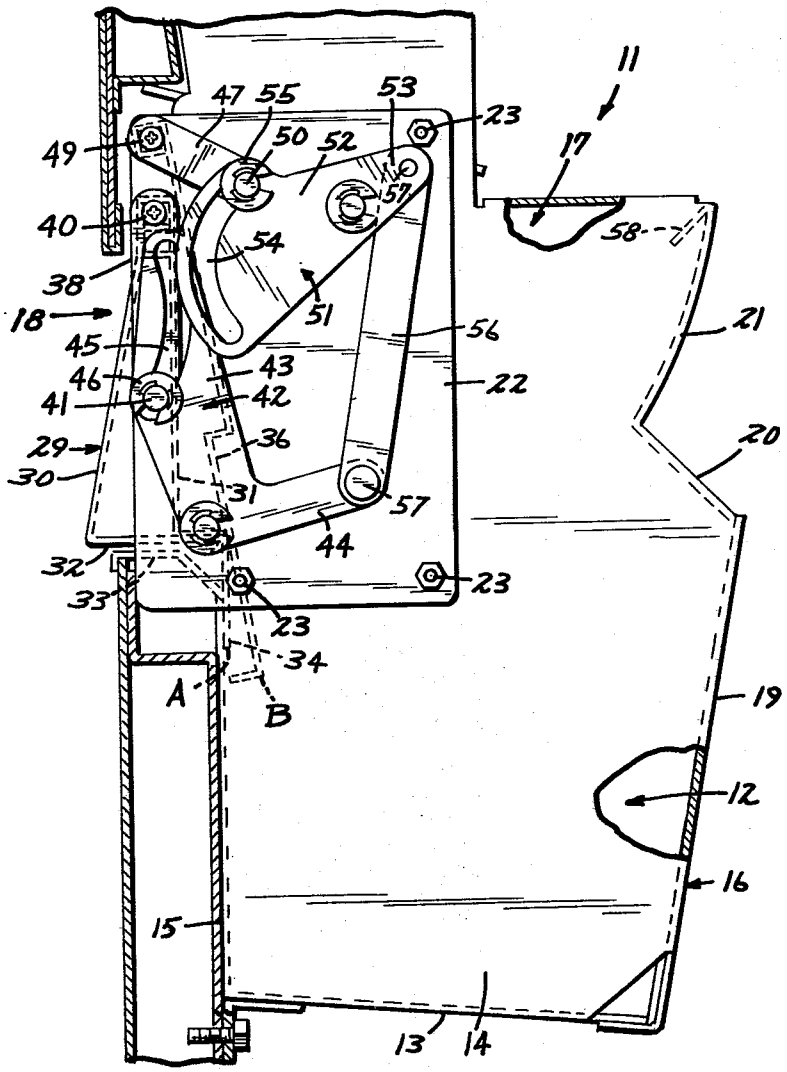
FIG. 3 is a view in side elevation taken generally along the line 3—3 in FIG. 2 illustrating the safety dispensing apparatus as disposed in its normally closed position.

FIGS. 3, 4, and 5 indicate the relative positions of the delivery door 29 and the supply door 36 at three critical positions during the operation of the apparatus of this invention. FIG. 3 illustrates the relationship in the normally closed position, wherein the delivery door 29 is positioned at point A and the supply door 36 at point B. FIG. 5 illustrates the relative positions with the delivery door 29 in a partially open position at point A′, the supply door 36 at point B′. Likewise, FIG. 4 shows the relative positions with the delivery door 29 in fully opened position at point A″, the supply door 36 at point B″. It will be noted that an initially relatively small movement of the delivery door 29 from A to A′ results in a relatively larger movement in the supply door 36 from B to B′. It will be apparent that by the time the delivery door 29 has been moved sufficiently for the front panel 30 to clear the top of the front wall 15 (thus opening access to the dispensing chamber 12), the end of the supply door 36 will be positioned adjacent the curved portion 21 of the rear wall 16, thereby closing access to the supply opening 17.

At some point B′ when the supply door 36 is adjacent the curved portion 21, the situation will reverse. That is to say, further opening movement of the delivery door 29 from A′ to A″ will result in a relatively slower closing movement of the supply door 36 from B′ to B″. Thus, once past A′–B′, a relatively large movement imparted to the delivery door 29 will result in a realtively smaller movement imparted to the supply door 36.

These relative movements, of course, operate in reverse upon closing. When an inward force is no longer applied to the delivery door 29, the doors 29 and 36 gravitate back toward points A and B, respectively. It has been found that, upon closing, the doors 29 and 36 are less likely to become hung-up, thus failing to return to their normal positions, due to the initially greater closing rate of the delivery door 29 relative to the supply door 36. This represents another advantage of the present invention over the prior art devices.

In operation, it will be seen that inward movement of the delivery door 29 will be directly translated to the delivery door lever arm 38 as an angular movement about that end of the lever arm 38 which is attached to the delivery door hanger 28. As illustrated in FIG. 3, pivoting of the delivery door lever arm 38 causes the drive pin bearing end thereof to move in a counterclockwise direction within the arcuate slit 45 of the bell crank 42, causing downward, clockwise movement of the outer end of the second lever arm 44 of the bell crank 42. Forces from this motion are transmitted to the link 56 through the pivot pin 57 contained in the second lever arm 44 of the bell crank 42 so as to cause downward movement of the link 56. The downward movement of the link 56 is translated to the fixed pivot lever arm 51 through the pivot pin 57 resulting in pivoting of the lever 51 in a clockwise direction about its fixed pivot point. The rotational movement of the fixed pivot lever 51 will be imparted to the supply door lever arm 47 by the motion of the second arcuate slit 54 relative to the second drive pin 50 attached to the supply door lever arm 47, causing the supply door lever arm 47 to rotate in a counterclockwise direction. The rotating supply door 36 thus closes the supply opening 17.

It will be noted that while operation of the linkage means illustrated in FIGS. 3 and 4 has been described, the same cooperative relationships apply to the linkage means on the opposite side of the machine 10 with the apparent rotational directions being appropriately reversed.

Several important features should be noted with respect to the preferred embodiment apparatus. First, it will be noted that the distance between the pivot points of the bell crank 42 and the drive pin 41 of the delivery door lever arm 39 increases as the drive pin 41 travels the length of the arcuate slit 45, due to the relation of the arcuate slit 45 relative to the pivot point. This results in an initially large relative angular movement of the second lever arm 44 of the bell crank 42 which decreases as the distance between drive pin 41 and the pivot of the bell crank 42 increases. The resultant movement of the initially larger angular movement of the second lever arm 44 of the bell crank 42 is translated to the second lever arm 53 of the fixed pivot lever 50 by means of the link 56. It will also be noted that the distance between the second drive pin 50 and the pivot point of the fixed pivot lever 51 increases as the second drive pin 50 moves from its at rest position and travels along the second arcuate slit 54. The initially larger angular movement of the second lever arm 53 of the fixed pivot lever 51 is imparted to the supply door lever arm 47. As the angular motion imparted to the second lever arm 53 decreases the subsequent lag is compensated for by the increasing distance between the second drive pin 50 and the pivot point of the fixed pivot lever 51. Accordingly, an initially relatively small angular movement of the delivery door lever arm 38 is translated into an initially relatively larger angular motion of the supply door lever arm 47. In this manner, it is possible to completely close-off access to the product storage area of the vending machine 10 by the time that the delivery door 29 has moved sufficiently for the front panel 30 to clear the front wall 15 of the dispensing chamber 12.

While a particular embodiment of the invention has been described here, it will be understood that the present invention is not limited thereby, but is limited only by the scope and breadth of the appended claims.

What is claimed is:

1. In combination with a dispensing machine including a dispensing chamber having a top supply opening and a front delivery opening, a safety door mechanism comprising:

(a) a delivery door pivoted about a horizontal axis near the top of the delivery opening, and normally positioned by gravity to close the delivery opening;

(b) a supply door pivoted about a horizontal axis above the delivery door horizontal pivot axis, near the front of the supply opening and normally positioned by gravity to clear the supply opening, said supply door depending behind said delivery door; and (c) linkage means interconnecting said supply and delivery doors for closing said supply door in response to opening movement of said delivery door at a closing rate which initially exceeds the opening rate of said delivery door, so that said supply opening is substantially closed before said delivery opening is substantially open, and at a slower rate thereafter until said delivery door is in its full open position; said linkage means comprising a pair of linkage mechanisms, one of said mechanisms interconnecting said doors at each side of said dispensing chamber.

2. In combination with a dispensing machine including a dispensing chamber having a top supply opening and a front delivery opening, a safety door mechanism comprising:

(a) a delivery door pivoted about a horizontal axis near the top of the delivery opening and normally positioned by gravity to close the delivery opening;

(b) a supply door pivoted about a horizontal axis near the front of the supply opening and normally positioned by gravity to clear the supply opening, said supply door depending behind said delivery door; and (c) linkage means interconnecting said supply and delivery doors for closing said supply door in response to opening movement of said delivery door at a closing rate which initially exceeds the opening rate of said delivery door, so that said supply opening is substantially closed before said delivery opening is substantially open; said linkage means comprising a pair of linkage mechanisms, one of said mechanisms interconnecting said doors at each side of said dispensing chamber, wherein each of said linkage mechanisms comprises:

(i) a delivery door lever arm pivoting with said delivery door and having a first drive pin adjacent its free end;

(ii) a bell crank having a fixed center pivot, a first lever arm containing an arcuate slit receiving said first drive pin therein, and a second lever arm having a first pivot pin;

(iii) a supply door lever arm pivoting with said supply door and having a second drive pin adjacent its free end;

(iv) a fixed pivot lever having a first lever arm containing an arcuate slit receiving said second drive pin therein, and a second lever arm having a second pivot pin adjacent its free end; and (v) a link pivotally connecting said first and second pivot pins.

3. The combination according to claim 2, wherein said first lever arm of said bell crank is longer than said second lever arm of said bell crank.

4. The combination according to claim 3, wherein said arcuate slit in said first lever arm of said bell crank extends generally radially outward from the center pivot of said bell crank.

5. The combination according to claim 2, wherein said first lever arm of said fixed pivot lever is longer than said second lever arm of said fixed pivot lever.

6. The combination according to claim 5, wherein said arcuate slit in said first lever arm of said fixed pivot lever extends at an increasing radius about the pivot point of said fixed pivot lever.

7. In combination with a dispensing machine including a dispensing chamber having a top supply opening and a front delivery opening, a safety door mechanism comprising:

(a) a delivery door pivoted about a horizontal axis near the top of the delivery opening and normally positioned by gravity to close the delivery opening;

(b) a supply door pivoted about a horizontal axis near the front of the supply opening and normally positioned by gravity to clear the supply opening, said supply door depending behind said delivery door;

(c) a pair of linkage mechanisms, one of said mechanisms interconnecting said doors at each side of said dispensing chamber, each of said mechanisms comprising:

(i) a delivery door lever arm pivoting with said delivery door and having a first drive pin near its free end;

(ii) a bell crank having a fixed center pivot, a first, longer lever arm containing an arcuate slit extending generally radially from said center pivot and receiving said first drive pin therein, and a second, shorter lever arm having a first pivot pin;

(iii) a supply door lever arm pivoting with said supply door and having a second drive pin near its free end;

(iv) a fixed pivot lever having a first, longer lever arm containing an arcuate slit of increasing radius about the pivot point of said fixed pivot lever receiving said second drive pin therein, and a second, shorter lever arm having a second pivot pin near its free end; and (v) a link pivotally connecting said first and second pivot pins.

8. The combination according to claim 7, wherein said delivery door comprises a front panel and a rear panel, said rear panel being positioned inwardly of said dispensing chamber with respect to said front panel.

9. The combination according to claim 7, wherein a rear wall of the dispensing chamber comprises a curved portion conforming generally to the arc swept out by said supply door when said safety door mechanism is operated to close the supply opening.

* * * * *